United States Patent [19]

Heyer et al.

[11] Patent Number: 4,834,346

[45] Date of Patent: May 30, 1989

[54] LADLE LID ARRANGEMENT

[75] Inventors: Klaus W. Heyer, Dundas; Richard L. Minion, Burlington; Aleksandar Pavlica, Hamilton, all of Canada

[73] Assignee: Stelco Inc., Hamilton, Canada

[21] Appl. No.: 159,534

[22] Filed: Feb. 9, 1988

[51] Int. Cl.[4] ..... C21C 5/42

[52] U.S. Cl. ..... 266/143; 266/275; 432/250

[58] Field of Search ..... 266/165, 177, 143, 287, 266/275, 901, 242; 432/250; 220/285

[56] References Cited

U.S. PATENT DOCUMENTS 3,907,260 9/1975 Leatherby ..... 266/287

4,389,191 6/1983 Lowe ..... 432/250

FOREIGN PATENT DOCUMENTS 0399549 2/1974 U.S.S.R. ..... 266/143

*Primary Examiner*—Scott Kastler

*Attorney, Agent, or Firm*—Sim & McBurney

[57] ABSTRACT

A light-weight ladle lid cooperates with a lifting assembly positioned to remove the ladle lid as the ladle moves toward a filling location, and to allow the lid to be drawn back down onto the ladle when the latter retraces its path. The assembly has ramp-like fingers which engage horizontal pins supported from the lid. The lid is hinged to the ladle by pins received in but disengageable from slots.

16 Claims, 4 Drawing Sheets

142
144
132
134
145
148
140
138
136
149
88
129
130
118
125
150
122
76
45
24
90
96
92
98
102
94

LADLE LID ARRANGEMENT

This invention relates generally to teeming operations, and has to do particularly with an innovative design for a ladle lid, together with a mechanism for automatically lifting the lid off the ladle when it is desired to fill the same with molten metal and subsequently replacing the lid.

BACKGROUND OF THIS INVENTION

The idea of providing lids for ladles is not new. Reference may be had to an article entitled "Operating Results Obtained with Dolomite and Bauxite Ladle Linings in the BOS Steelmaking Plant of the Dillinger Huttenwerke AG", by K. H. Bauer and R. Quinten, published in Stahl Eisen 1980 100 (18), pp. 1045–1050.

Generally speaking, the advantages of providing a lid for a molten metal ladle can be summed up under the following headings: better heat retention, improved life of higher quality refractories, and increased crane availability. In installations where no lids are provided for ladles, an individual cleaning out a ladle stands behind a large shield which is fixed in a permanent location, while an overhead crane supports the ladle in front of the shield. In some installations, when one crane is immobilized, other cranes on the same crane rails can also be restricted. In essence, a ladle lid eliminates the necessity for a shield, thus resulting in increased crane availability, since the crane is no longer engaged in holding the ladle during cleaning.

In addition to the self-evident improved heat retention, there tends to be less "pancaking" or "skulling" in the ladle. A "pancake" is a flat and usually circular mass of solidified steel or slag that "freezes" in the ladle, usually on the bottom, as a result of temperature being insufficient to prevent solidification. "Pancaking" is the formation of "pancakes".

"Skulling" similarly refers to the formation of "skulls". These are basically pancakes with edges. They can also refer to the shell of metal that occasionally solidifies on the sides and bottom of the interior of the ladle.

Furthermore, the provision of a ladle lid permits the use of higher quality refractories in the ladle that are more susceptible to spalling. Spalling results from inadequate resistance to thermal shock, and is the breaking away of pieces of refractory from the hot face, thus exposing fresh surfaces. Spalling may result from a too-rapid expansion or contraction of the hot face of the refractory with sudden temperature changes. This type of spalling is called thermal spalling. By providing a ladle lid, heat retention in the ladle refractory is improved, thus minimizing thermal shock.

It will be understood that, generally, there is always a certain amount of residual heat in a ladle between heats even when the ladle is empty. If the empty ladle remains uncovered, approximately 70% of the heat is lost to the surrounding atmosphere by radiation, with the remaining 30% of the heat loss occurring as a result of conduction from the hot face of the refractory through to the inner colder refractory adjacent the steel ladle shell. If the same empty ladle were covered, the radiation losses would be eliminated, and the loss resulting from conduction into the colder refractory would be reduced.

The above heat losses are different from the losses occurring when the ladle contains molten steel. When the ladle contains molten steel and is uncovered, approximately 30% of the heat loss results from radiation losses from the molten steel or slag surface to the atmosphere, whereas approximately 70% of the heat is lost by conduction to the refractory from the surfaces in contact with the refractory walls and bottom. When an empty hot ladle is filled with molten steel and covered, radiation losses are again eliminated, and the conduction temperature losses to the refractories are significantly reduced, because of the high refractory temperature.

As is well known, the typical furnace installation for making steel includes a relatively large vessel from which steel is periodically tapped into ladles. A typical ladle may be approximately 18 feet high, and from 10 to 12 feet in diameter at the top. Normally, a ladle is supported and transported on a ladle transfer car which runs on tracks along a path which takes it under the steelmaking vessel. The ladle serves as an intermediate container to transfer steel from the vessel to a teeming location. The teeming may take place into ingot molds or into a tundish for continuous casting.

The temperature of the steel when first tapped from the vessel must be high enough to ensure that it will remain above a predetermined casting temperature for the time during which steel remains in the ladle. Naturally, if the ladle has an open top, considerable heat is lost from the melt, and the temperature of the melt will drop more rapidly over time. The losses have already been discussed above in detail.

In determining an appropriate construction for such a ladle lid, however, certain factors must be kept in mind. Firstly, it is obviously preferable to be able to retrofit lids onto existing ladles, certainly from an economic point of view. Most ladles are constructed in such a way that the large trunnion pins, located at diametrically opposed positions on the ladle, are close to but slightly above the center of gravity of the ladle when empty. This means that the procedure of dumping the ladle does not require excessive tipping force to be applied by the crane when raising the bottom end. The fact that the trunnion pins are close to the center of gravity, however, means that any retrofitted lid must not be excessively heavy, for fear that it would cause an overbalancing or over-tipping of the ladle when a certain angle is reached during the tipping procedure. In other words, the ladle lid must not be so heavy that the center of gravity is raised to a location above the axis of the trunnion pins.

Another factor to be kept in mind relates to the necessity of lifting the ladle lid off the ladle prior to running the ladle under the steel making vessel for tapping, and then replacing the lid on the ladle after the ladle comes out from under the vessel. Naturally, this could be done using a crane hook, but such a procedure would tie up a crane which might otherwise be made better use of elsewhere in the plant. Thus it would be desirable to provide a special lifting apparatus which will automatically remove the lid from the ladle as it approaches the steelmaking vessel, and which will allow the lid to be placed back on the ladle, again automatically, as the ladle comes out from under the vessel. By "automatically" is meant that the lid is removed from and replaced on the ladle by the power of the ladle transfer car.

GENERAL DESCRIPTION OF THIS INVENTION

In view of the foregoing discussion, it is an aim of one aspect of this invention to provide a lid for a ladle which may be retrofitted, and which is sufficiently light in weight as not to raise the resultant ladle center of gravity to a point above the axis of the trunnion pins.

It is an aim of another aspect of this invention to provide a combined ladle, lid and lifting assembly, the latter adapted automatically to raise the lid off the ladle as the same approaches the steelmaking vessel, and to replace the lid on the ladle when the ladle retraces its path and moves away from the vessel.

According, this invention provides, in combination:

a ladle for molten metal, the ladle being a container having an upper rim, a lid adapted to close the top of the container by sitting on said rim, means for moving the ladle along a predetermined path, a lifting assembly so located that, when the ladle moves along said path, it passes adjacent the lifting assembly, sloping ramp means on one of (a) the lifting assembly and (b) the lid, and follower means engageable by the ramp means on the other of (a) the lifting assembly and (b) the lid, whereby when the ladle is adjacent said lifting assembly, the ramp means can engage the follower means to cause the lid to be lifted off the ladle.

In another aspect, this invention provides, in combination:

a ladle for molten metal, the ladle being a container with an upper rim, a lid adapted to close the top of the container by sitting on said rim, a lifting assembly located such that the ladle can be moved along a path passing adjacent the lifting assembly, the lid being free of direct attachment to the lifting assembly, means on the lifting assembly and on the lid adapted to cooperate to lift the lid off the ladle as the ladle passes adjacent the lifting assembly, coaxial hinge pins supported by bracket means from the ladle and fixed with respect thereto, and two hinge brackets on the lid, each hinge bracket defining a downwardly opening slot adapted to receive one of said hinge pins, the hinge pin axis being located above the plane of the upper rim of the container and rearwardly thereof when seen in plan view, each hinge bracket extending rearwardly from the lid and having a first part forwardly of its slot and a second part rearwardly of its slot, the two parts being integral above the slot, the second part extending downwardly further than the first part so that its protruding end can be struck by the respective hinge pin when the ladle is retracing the said path, thus drawing the lid back down onto the ladle.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
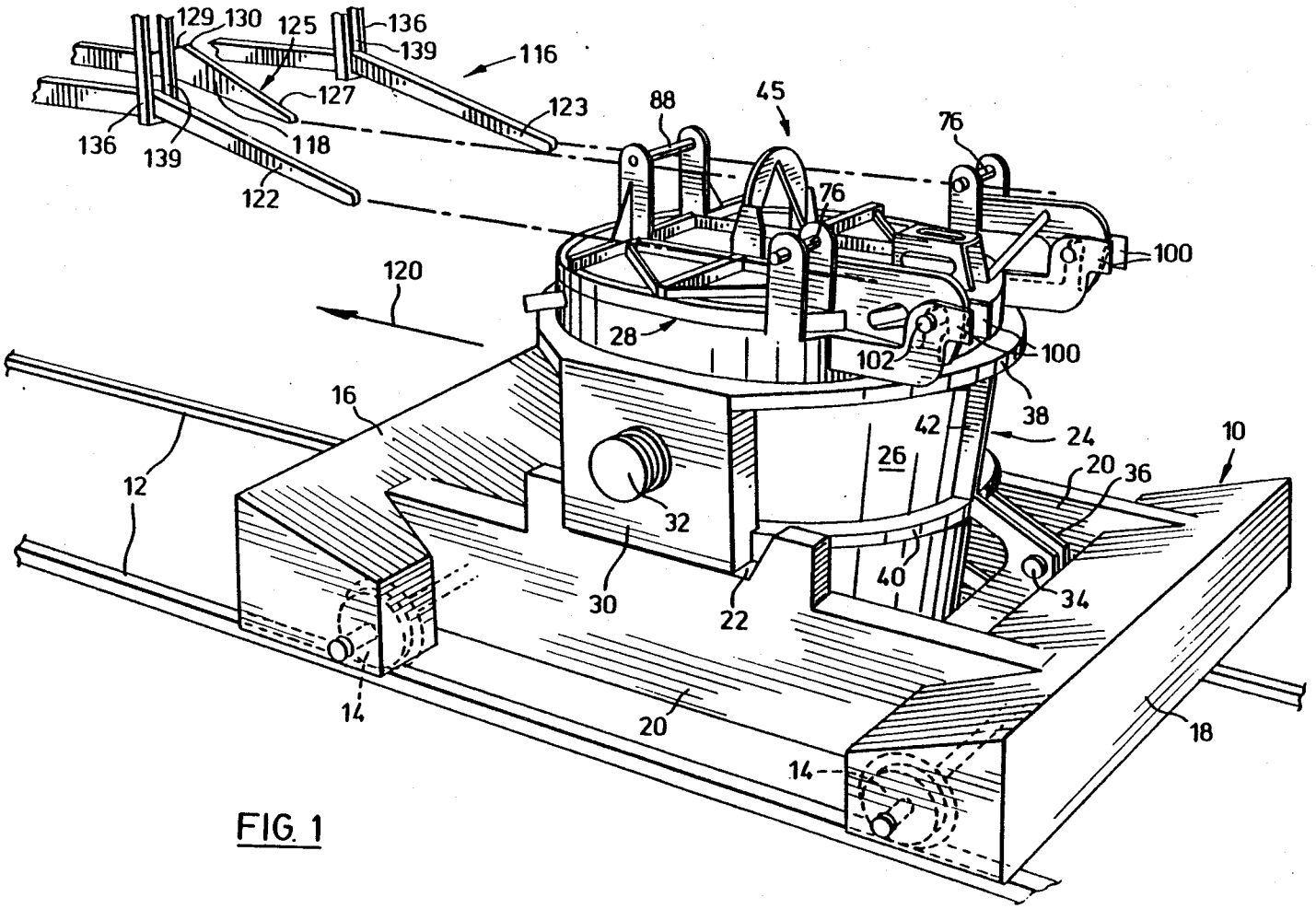
FIG. 1 is a perspective view of a ladle, a lid on the ladle, and a ladle car, all approaching the lifting apparatus.

Attention is first directed to FIG. 1, which shows a ladle car generally at 10, the car 10 running on tracks 12.

The car 10 is of standard construction, including four wheels 14 (two of them shown in broken lines), a forward transverse structure 16, a rearward transverse structure 18, and two longitudinal, spaced-apart support members 20, each of which defines a surface 22 upon which a ladle, shown generally at 24, can rest.

The ladle 24 is generally of conventional construction, and is constituted by a cup-like body 26 of frustoconical configuration with a substantially flat bottom, and having an upper rim 28.

The ladle 24 includes two diametrically opposed brace configurations 30 (only one of these being visible in FIG. 1), each brace configuration 30 supporting a horizontally extending trunnion pin 32, both trunnion pins being in alignment diametrally across the ladle 24.

In the normal construction of a ladle, the common axis of the trunnion pins is located slightly above the plane of the center of gravity of the ladle when empty, so that in order to tip the ladle over to remove slag, etc., it can be suspended by two appropriately sized crane hooks around the trunnion pins, and then a third hook can raise the base of the ladle upwardly thus rotating the ladle about the axis of the trunnion pins. The third hook typically engages a pin 34 in an L-shaped bracket 36 which is hingedly connected to the bottom of the ladle 24 at a point intermediate the two trunnion pins 32.

Normally, ladle is tipped only for discharging slag, for ladle maintenance and inspection, or for purposes of cleaning. The tapping of molten steel from the ladle is generally accomplished by teeming the steel out through an opening in the bottom of the ladle.

The ladle 24 further includes external reinforcement rings 38 and 40, together with vertical reinforcement bars 42. Internally, the ladle contains any refractory material capable of withstanding high temperatures.

All of these elements are well known in the art, and no further detailed discussion of the ladle itself is necessary, beyond the additional elements required to adapt it to receive a lid.

The lid which is provided by the present invention is shown generally in FIG. 1 by the numeral 45. The lid is adapted to close the top of the body 26 of the ladle 24 by sitting on the rim 28.

Figure 2:
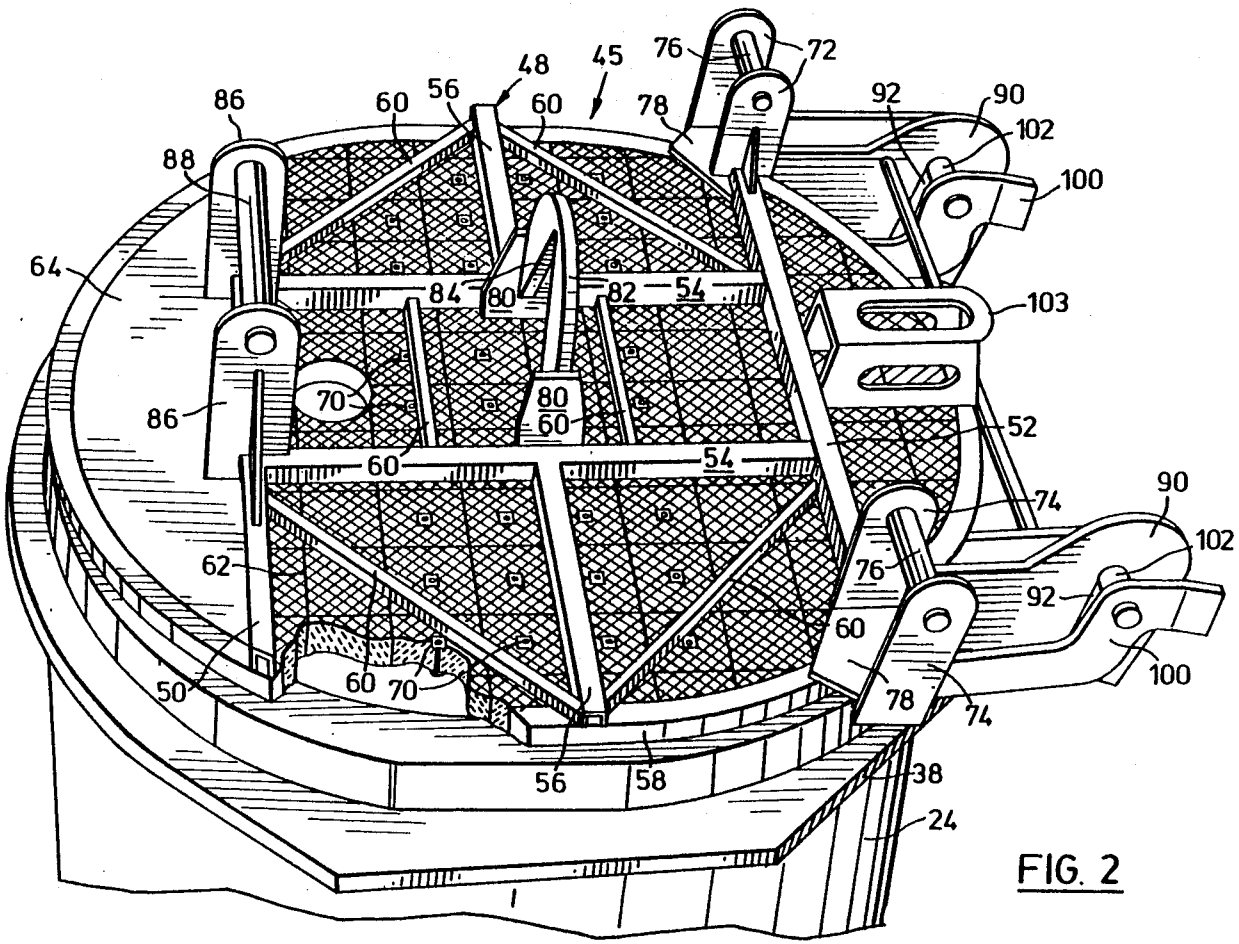
FIG. 2 is a partly broken-away perspective view of the ladle lid in position on a ladle.

Attention is now directed to FIGS. 1 and 2, for a more detailed description of the lid itself.

As previously mentioned, one aspect of this invention is to provide a lid which is of relatively light weight, in order to avoid over-balancing the ladle when the latter is being tipped. Accordingly, as seen in FIG. 2, the lid 45 includes a framework 48 of hollow sections, typically rectangular, hollow-section steel members. More particularly, the framework 48 includes a forward lateral member 50, a rearward lateral member 52, two spaced-apart longitudinal members 54, two coaxial lateral members 56 each being outboard of one of the longitudinal members 54, an annular peripheral member 58, and a plurality of smaller-section cross-braces 60.

Secured to and below the framework 48, but above the peripheral member 58, is an expanded metal mesh 62, drawn in FIG. 2 as a network of crossing lines on the diagonal. The mesh 62 covers the entirety of the lid 45, with the exception of the portion 64 located at what will be referred to as the forward end in this disclosure. The portion 64 is covered by a plate of steel.

Suspended below the metal mesh 62 is a refractory material, preferably of low density and thus light in weight. A number of different kinds of such refractory materials are available. For example, a sinusoidally folded ceramic fibre refractory material can be provided in modules which are fitted between downwardly depending brackets with securement rods extending between the brackets and directly through the refractory material. The brackets are attached by welding, bolting, or otherwise fastening to the underside of the expanded metal mesh 62. FIG. 2 shows a plurality of nuts 70 threaded on bolts which secure the light weight refractory material to the underside of the steel mesh 62. Such low density refractory material may have a density of less than 10 lbs./cu.ft.

The steel plate at portion 64 supports either a plastic or a castable refractory material either rammed or cast into place. The refractory material at portion 64 is a high density material capable of withstanding contact with hot slag or metal. The resulting increased weight at portion 64 counterbalances the weight of the hinges 90 (described below), and also does not interfere with ladle balance. Such material may have a density in the region of 160 lbs./cu.ft.

Toward the rear of the lid 45, which is at the right in FIG. 2, can be seen a first pair of spaced-apart upstanding brackets 72, and a second pair of spaced-apart upstanding brackets 74. Each pair of brackets 72 and 74 supports a horizontal pin 76, the two pins 76 being coaxial and having their common axis extending transversely in terms of the forward-rearward orientation of the lid 45. For each pair of brackets 72 and 74 there is provided a base plate 78 which is welded to the framework 48 of the lid 45.

Centrally of the lid 45, two upstanding brackets 80 are secured to the longitudinal members 54, and between them support a yoke 82 having a circular outer periphery and an inverted V-shaped notch 84 adapted to be engaged by a crane hook in order to raise the lid 45 in the event that a crane is to be utilized. It will be understood from what follows, however, that the normal manipulation of the lid with respect to the ladle is done by a separate mechanism which will be described subsequently.

Toward the forward end of the lid 45, at the rear edge of the portion 64, is a further pair of brackets 86, which support between them a further horizontal pin 88 oriented transversely to the forward-rearward direction of the lid 45, so that all of the pins 76 and 88 are parallel. The brackets 86 are spaced equidistantly on either side of the center line through the lid at right angles to the axial direction of the pins 76 and 88.

Figure 7:
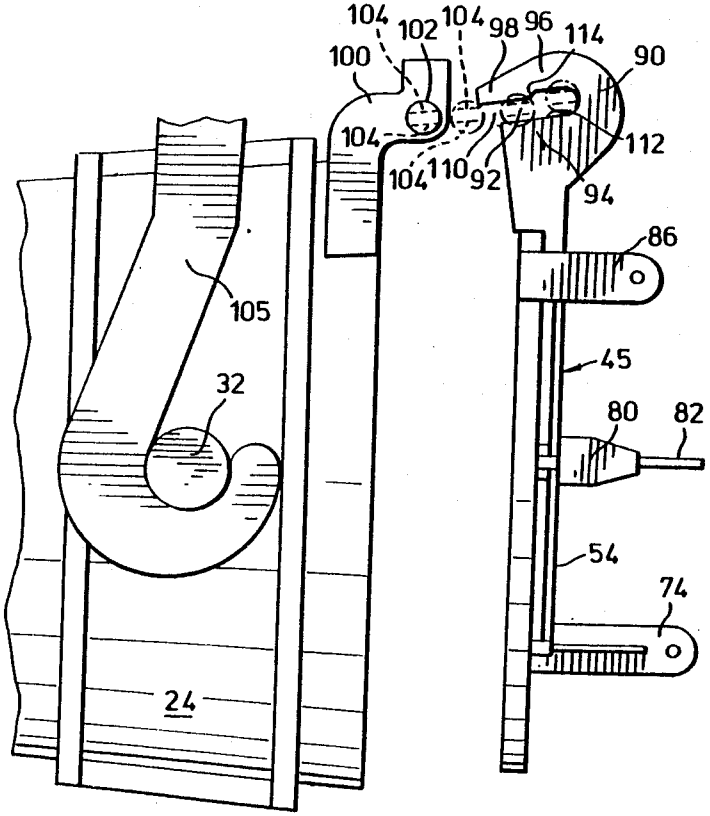
FIG. 7 is a partial side elevation of a ladle and lid showing one way in which the lid can be applied to a ladle.

Extending rearwardly from the lid 45, and parallel with each other, are two hinge brackets 90, the shape of which is best seen in FIG. 7. More particularly, each hinge bracket 90 defines a downwardly opening slot 92 adapted to receive a hinge pin supported from the ladle. The hinge pins will be described subsequently.

Referring to FIG. 7, each hinge bracket 90 is shaped to define a first part 94 forwardly of its slot 92, and a second part 96 rearwardly of its slot 92. The two parts 94 and 96 are integral above the slot 92 (to the right in FIG. 7), and as can be seen, the second part 96 extends downwardly (leftwardly in FIG. 7) farther than the first part 94, in order to provide a protruding end 98. The purpose of this protruding end will be described subsequently.

Referring now to FIGS. 1, 2 and 7, it will be seen that the ladle 24 has provided thereon two pairs of brackets 100 which extend rearwardly from the ladle. Each pair of brackets 100 supports a hinge pin 102 adapted to be received in the respective slot 92. The brackets 100 are somewhat S-shaped in order to allow the pins 102, which are coaxial, to be located above the plane of the rim 28 of the ladle 24, for a reason which will now be explained.

Figure 8:
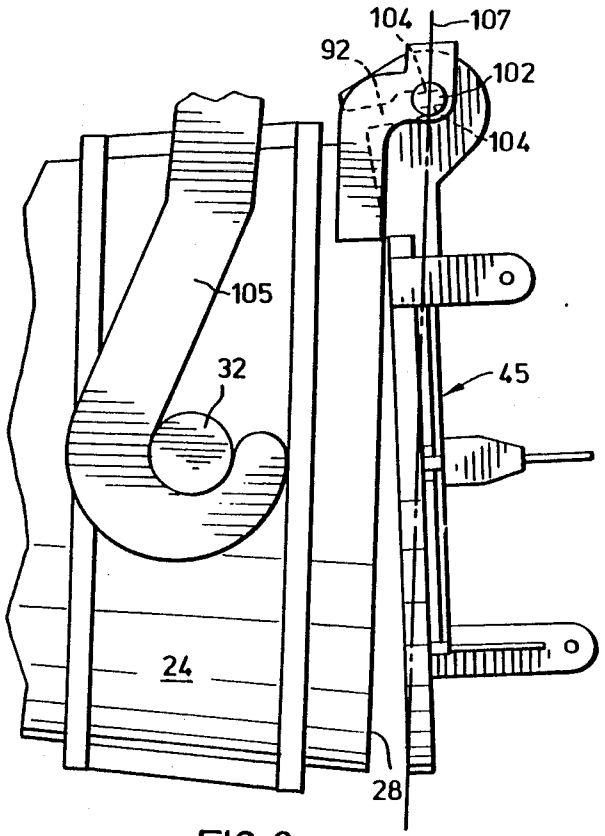
FIG. 8 shows a lid in place on the ladle, with the ladle being tipped.

In order to allow the use of lightweight refractory on the underside of the lid, it is important to minimize any contact between that refractory and high temperature materials such as molten metal or slag within the ladle. Such low density refractories are easily eroded by such contact. Normally, the only time that such contact could occur is during pouring off of slag, when the ladle is supported by two crane hooks 105 as seen in FIG. 8, and then is tilted by a third crane hook which is attached directly to the bottom end of the ladle or directly to a linkage member which is in turn attached to the bottom.

In order to ensure that the lid 45 will begin to open away from the rim 28 of the ladle 24 before the slag runs up to the rim 28, the hinge axis of the lid 45 is displaced above (to the right in FIG. 8) the plane of the rim 28. The broken line 107 passes through the hinge pin 102 and also through the center of gravity of the lid 45, and it will be seen that the lid has begun to open away from the rim 28 of the ladle 24, at a point in time when the ladle is only just passing the position in which its axis is horizontal. In other words, it is only upon reaching the position shown in FIG. 8 that the viscous slag inside the bottom of the ladle will begin to run up along the wall toward the rim 28. By the time the viscous slag reaches the rim 28, the lid 45 will have opened far enough away to avoid any contact with the hot slag.

At the rear of the lid 45, i.e. at the right in FIG. 2, is an upstanding rectangular structure 103, which is provided as an auxiliary lifting lug when lifting the lid vertically so that a crane can remove and replace the lid to a "make-up" station when the ladle is horizontal. Alternatively, when the lid is being stored vertically, the structure 103 can be used to remove and replace it from the storage rack.

There is a provision with respect to the hinge pins 102 which locks the lid 45 to the pins whenever the lid has moved through a certain angle away from its position when lying flat against the ladle 24 and closing the same. The provision can be seen in FIGS. 7 and 8. The hinge pins 102 are basically cylindrical, having a typical diameter of 6" and a length of 13". However, the mid-portions of the pins are reduced to a width of about 4" by providing two opposed flats over a central length of about 6". This facilitates entry into the neck portion of the respective slots, the neck portion being only slightly greater than 4" in width. However, if the lid 45 is rotated, for example through 90°, while the pin is in the wider slot portion 112 at the right in FIGS. 7 and 8 (later to be described), the pin will present the full 6" diameter to the neck portion of the slot which is less than 6" wide, thus preventing removal of the lid from its engagement with the pins. The pin configuration can be arranged such that departure of the lid from its flat covering position by more than a small angle (approximately 20°) will effectively lock the lid to the pins. Thus, the hinge assembly can be locked during slag dumping, during which the pin 102 rotates in a clockwise direction relative to the respective hinge bracket 90 (since the lid 45 will tend, through gravity, to hang downwardly in a generally vertical position). This will physically prevent the pin 102 from being dislodged from the respective bracket 90.

In FIGS. 7 and 8, broken lines 104 represent the surfaces of the flats where the pin diameter is reduced.

Attention is now directed to FIG. 7 which illustrates one manner in which a lid 45 can be applied to a ladle 24. The lid is positioned on a support (not shown) with its general plane vertical, such that the hinge brackets 90 are uppermost. In FIG. 7, the slot 92 opens to the left, and it can be seen that crane hooks 105 are supporting the ladle 24 and moving it rightwardly toward engagement with the lid 45. In order to maintain the ladle in the orientation shown at FIG. 7, a further crane hook would have to support the bottom end at the appropriate location. The ladle 24 is simply moved to the right until the pins 102 engage the respective slots 92, and pass in to the ends of the slots 92.

It will be noted in FIG. 7 that each slot 92 is slightly angled with respect to a plane parallel with the main extent of the lid 45. More specifically, each slot 92 extends upwardly and rearwardly. Moreover, each slot 92 has a lower neck portion 110 adapted to receive its respective hinge pin 102 with a slight clearance, and an upper portion 112 which is wider than the neck portion 110 by virtue of a rearward step 114 in the rear edge of the slot 92 defined by the second part 96 of the hinge bracket 90. Moreover, it will be noted in FIG. 7 that, once the hinge pin 102 has entered as far as possible into the slot 92, a subsequent upward movement of the ladle 24 will locate the hinge pin 102 at the uppermost (most rearwardly) location with respect to the slot 92. In effect, the enlargement rearwardly of the inner recess of the slot 92, together with the general upward and rearward slope of the slot 92, ensures that the lid 45 will not fall outwardly off the ladle 24 as the ladle 24 moves upwardly from its orientation as seen in FIG. 7.

Attention is now directed to FIG. 1, to the upper left portion thereof, which shows the lower portion of a lifting assembly 116. The lifting assembly 116 includes a forward finger 118 (i.e. forward in the sense of the "forward" arrow 120 showing the direction followed by the ladle when it is moving toward the steelmaking vessel), the forward finger 118 being positioned substantially centrally with respect to the path of the ladle 24. The lifting assembly 116 also includes two rearward fingers 122 and 123 at substantially equal spacings to either side of a hypothetical line through the forward finger and parallel with the path represented by the arrow 120. It will be noted that the two rearward fingers 122 and 123 slope rearwardly and downwardly, and are positioned in such a manner as to engage under the horizontal pins 76. The forward finger 118 has a top edge 125 which includes a downwardly and rearwardly sloping longer portion 127 and a downwardly and forwardly sloping shorter portion 129. The top edge 125 thus has a peak 130 between the aforesaid portions. The forward finger 127 is adapted to engage under the pin 88.

Figures 3, 4, 5, 6:
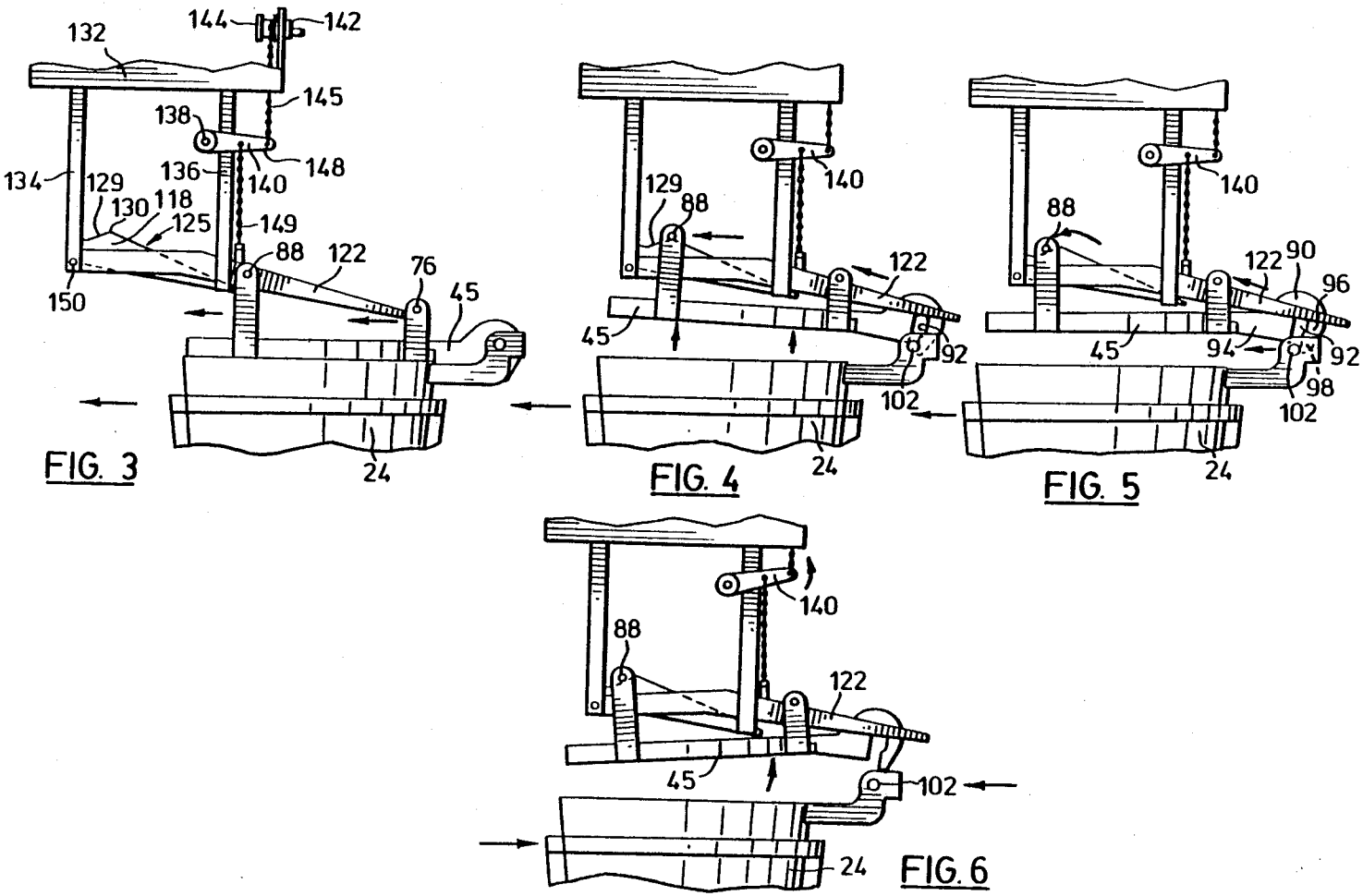
FIGS. 3, 4 and 5 show sequential steps in the removal of the ladle lid by the lifting apparatus.
FIG. 6 shows the lifting apparatus raising the lid out of the way of the ladle, to avoid replacing the lid if desired.

A better idea of the construction of the lifting assembly 116 can be gained from FIG. 3. A frame 132 is suspended from above by means not shown, and supports two forward upright members 134 and two upright rearward members 136. The rearward members 136 are aligned with the fingers 122 and 123, and as seen in FIG. 1 they define a U-shaped slot 139 against the bottom of which the respective fingers 122 and 123 rest.

The fingers 122 and 123 are pivoted at the bottom of the members 134, so that they can be raised by rotating in the counterclockwise sense as seen in FIG. 3. Brace members (not shown) extend between the forward upright members 134 and rigidly support the forward finger 127.

The mechanism for raising the rearward fingers 122 and 123 is shown schematically in FIG. 3. A pivot point 138 fixed with respect to the rearward upright members 136 supports two rearwardly extending levers 140 located directly above the fingers 122 and 123. Supported with respect to the frame 132 is a motor 142 which controls a winch 144 adapted to wind up a chain 145, the chain being connected to the rearward extremity 148 of one of the levers 140. The two levers are locked together by being fixed with respect to a common shaft coincident with the pivot location 138. Each lever 140 supports from a location intermediate its two ends the upper end of a further chain 149, the lower end of which is attached to its respective finger 122 or 123. It will thus be appreciated that, when the motor 142 is energized to winch up the chain 145, the fingers 122 and 123 are caused to rotate in the counterclockwise sense about their pivot points 150 with respect to the forward upright members 134.

Attention is now directed to FIGS. 3, 4 and 5 for a description of the way in which the lifting assembly 116 removes the lid 45 from the ladle 24.

FIG. 3 shows the ladle 24 in a position just prior to engagement of the fingers 122, 123 and 127 with the respective horizontal pins 76 and 88. As the ladle 24 moves leftwardly from the position shown in FIG. 3 to that shown in FIG. 4, the horizontal pins begin to ride upwardly along their respective fingers. FIG. 4 shows the forward horizontal pin 88 just arriving at the peak 130 on the upper edge 125 of the forward finger 118, whereas the rearward horizontal pins 76 are at an intermediate location along their respective fingers 122 and 123. The slope of the various fingers has caused the lid 45 to be raised upwardly from the ladle 24 in the FIG. 4 position. It will further be noted at the right in FIG. 4, that the hinge pin 102 is now located in the neck portion of the slot 92 and is about to be free of the slot entirely.

FIG. 5 shows the lid 45 in a position in which the forward hinge pin 88 has passed over the peak 130 of the forward finger 118, and is now resting on the shorter, forward portion of the upper edge thereof, which slopes forwardly and downwardly. However, the rearward horizontal pins 76 remain on the rearwardly and downwardly sloping portion of the respective fingers 122 and 123. The fact that the forward horizontal pin 88 has passed over the peak 130 ensures that the lid 45 will not "run back down" along the fingers once it ceases to contact the ladle 24. With respect to the latter, it will be seen at FIG. 5 that the pin 102 is now clear of the first part 94 of the hinge bracket 90, i.e. it is located below the corner at the front of the slot 92. This means that further leftward progress of the ladle 24 will not seek to carry the lid 45 with it, since the lid was being pushed up the fingers by contact between the hinge pins 102 and the leftward edge of the slots 92. As soon as this contact ceases, as in FIG. 5, the lid is no longer pushed in the leftward or forward direction.

It will also be visualized easily that, after the ladle has received its charge of molten steel or other metal from the vessel (located leftwardly from the lifting assembly), and is returning along the same path so that it passes again underneath the lifting assembly, its first contact with the lid 45 will occur at the hinge pins 102, which contact the downwardly protruding end 98 of the second part (the rearward part) of the hinge bracket 90. This contact will physically force the lid 45 to the right, to follow along with the ladle 24, thus forcing the horizontal pin 88 up and over the peak 130 in the rightward direction, whereupon the entire lid will slide downwardly along the rearwardly and downwardly inclined fingers, coming to rest ultimately on top of the ladle 24, in the configuration shown in FIG. 3. In other words, to place the lid 45 back on the ladle 24, the figure sequence is: FIG. 5, FIG. 4 and FIG. 3.

If it is desired not to replace the lid 45 on the ladle 24 when the ladle moves back rightwardly under the lifting assembly, the motor 142 is energized while the lid is in the position of FIG. 5, thus lifting the rearward fingers 122 and 123 to a location such that the hinge pins 102 do not contact the downwardly protruding portions 98 of the second part 96 of the hinge brackets 90. This situation is shown in FIG. 6.

It will be appreciated, again referring to the lid replacement sequence from FIG. 5 back to FIG. 3, that the pin 102 contacts the rearward edge of the slot 92 at a point in time when the pin 88 is on the slope 129. Because the pin 88 must be raised up along the slope 129, the lid 45 presents some resistance against the urging of the pin 102. However, as the movement continues, the pin 88 passes over onto the downward slope 125, and at this point the weight of the lid overcomes the frictional forces of the slope 125 by design, and the lid then slips rearwardly such that the pin 102 contacts the front edge of the slot 92. This will mean that the pin will end up at the leftward extremity of the enlarged upper portion of the slot 92, after the lid has been replaced on the ladle 24. It is emphasized that this is not the same location as arises from the procedure shown in FIG. 7, in which the ladle lifts the lid 45 upwardly after being inserted such that the pins 102 enter the slots 92.

It is advantageous that the lid should end up in the situation just described following the replacement sequence shown in FIGS. 5, 4 and 3. The advantage relates to the desirability of "breaking the lid free" of any sticking to the ladle 24, in order to ensure that the lid 45 will begin to fall or open away from the ladle when the ladle is in the position shown in FIG. 8.

Looking at FIG. 8, if it were imagined that the pin 102 were located initially at the bottom of the slot 92, as would be the case following the sequence of FIGS. 5, 4 and 3, it will be seen that there is a slight clearance between the pin 102 and the top or rearward edge of the slot 92 which could allow the lid 45 to slide downwardly as soon as the ladle had tilted over through a certain angle. This initial short-distance sliding of the lid 45 would of course break any sticking or tendency to adhere to the ladle 24, possibly arising from solidified metal, etc. Then, when the ladle has been tilted further to the position of FIG. 8, the natural opening or falling away of the lid 45 (the beginning of which is illustrated in FIG. 8) can take place.

This ability of the lid 45 to slide before it opens is particularly important since the lid 45 is constructed to be as light as possible. The lightness of the lid could cause it to stick in place, if the construction were such that there were no possibility of sliding in order to break any adherence.

It will be appreciated from the foregoing that there has been provided a lid and lifting assembly construction which accomplish the aims of this invention, as set forth earlier.

While one embodiment of this invention has been illustrated in the accompanying drawings, and described hereinabove, it will be evident to those skilled in the art that changes and modifications may be made therein without departing from the essence of this invention as set forth in the appended claims.

The embodiments of the invention in which an exclusive property or privilege is claimed are defined as follows:

1. In combination:
- a ladle for molten metal, the ladle being a container having an upper rim,
- a lid adapted to close the top of the container by sitting on said rim,
- means for moving the ladle along a predetermined path,
- a lifting assembly so located that, when the ladle moves along said path, it passes adjacent the lifting assembly,
- sloping ramp means on one of (a) the lifting assembly and (b) the lid, and
- follower means engageable by the ramp means on the other of (a) the lifting assembly and (b) the lid,
- whereby when the ladle is adjacent said lifting assembly, the ramp means can engage the follower means to cause the lid to be lifted off the ladle.

2. The combination claimed in claim 1, in which the ramp means are part of the lifting assembly and the follower means are part of the lid, and in which the engagement of the ramp means with the follower means takes place as the ladle moves beneath the lifting assembly.

3. The combination claimed in claim 2, in which the ramp means includes a forward finger positioned substantially centrally with respect to the path of the ladle, and two rearward fingers positioned at substantially equal distances to either side of a hypothetical line through the forward finger and parallel with said path.

4. The combination claimed in claim 3, in which the follower means includes three pairs of upstanding brackets, the brackets of each pair being spaced apart and supporting between them a horizontal pin oriented transversely to said path.

5. The combination claimed in claim 4, in which the two rearward fingers slope rearwardly and downwardly.

6. The combination claimed in claim 5, in which the forward finger has a top edge which includes a downwardly and rearwardly sloping longer portion and a downwardly and forwardly sloping shorter portion, the top edge having a peak between the aforesaid portions, whereby the pin engaging the forward finger can pass over the peak to rest on the shorter portion of the top edge, thus preventing the lid from sliding rearwardly back down the fingers.

7. The combination claimed in claim 6, in which the lifting assembly includes raising means for selectively raising the positions of at least part of the finger means, thus raising the lid.

8. The combination claimed in claim 2, which includes two spaced-apart, coaxial hinge pins supported by bracket means from the ladle and fixed with respect thereto, the lid having two hinge brackets each defining a downwardly opening slot adapted to receive one of the said hinge pins.

9. The combination claimed in claim 8, in which the hinge pin axis is located above the plane of the upper rim of the container, and rearwardly thereof when seen in plan view, each hinge bracket extending rearwardly from the lid and having a first part forwardly of its slot and a second part rearwardly of its slot, the two parts being integral above the slot, the second part extending downwardly further than the first part so that its protruding end can be struck by the respective hinge pin when the ladle is retracing the said path, thus drawing the lid off the lifting assembly and back down onto the ladle.

10. The combination claimed in claim 9, in which each slot has a lower neck portion adapted to receive its respective hinge pin with a slight clearance, and an upper portion wider than the neck portion by virtue of a rearward step in the rear edge of the slot defined by said second part of the respective hinge bracket.

11. The combination claimed in claim 7, which includes two spaced-apart, co-axial hinge pins supported by bracket means from the ladle and fixed with respect thereto, the lid having two hinge brackets each defining a downwardly opening slot adapted to receive one of the the said hinge pins, the hinge pin axis being located above the plane of the upper rim of the cup-like body, and rearwardly thereof when seen in plan view, each hinge bracket extending rearwardly from the lid and having a first part forwardly of its slot and a second part rearwardly of its slot, the two parts being integral above the slot, the second part extending downwardly further than the first part so that its protruding end can be struck by the respective hinge pin when the ladle is retracing the said path, thus drawing the lid off the lifting assembly and back down onto the ladle, each slot having a lower neck portion adapted to receive its respective hinge pin with a slight clearance, and an upper portion wider than the neck portion by virtue of a rearward step in the rear edge of the slot defined by said second part of the respective hinge bracket.

12. The combination claimed in claim 1, in which the lid is of light-weight construction comprising an upper framework of hollow metal sections supporting below it a layer of expanded metal mesh, the latter in turn supporting below it a layer of refractory material.

13. The combination claimed in claim 8, in which the lid is of light-weight construction comprising over a major portion of its surface an upper framework of hollow metal sections supporting below it a layer of expanded metal mesh, the latter in turn supporting below it a layer of low density refractory material, and comprising over a minor portion of its surface remote from said two hinge brackets a solid steel plate which supports below it a layer of high density refractory material more resistant than said low density refractory material to damage from contact with hot slag or hot molten metal, whereby the concentration of weight at the location of the high density refractory material counterbalances the added weight due to the said hinge brackets and hinge pins.

14. The combination claimed in claim 9, in which each hinge pin has a non-circular cross-section where it engages its respective slot, each slot having a lower neck portion adapted to receive its respective hinge pin with a slight clearance when the lid is substantially parallel with said upper rim of the cup-like body, but incapable of receiving the respective hinge pin when the lid is angulated through a predetermined angle with respect to said rim, each slot further having an upper portion wider than the neck portion by virtue of a rearward step in the rear edge of the slot defined by said second part of the respective hinge bracket, the upper portion being able to receive the pin in any angular orientation.

15. The combination claimed in claim 14, in which the lid includes centrally located bracket means by which the lid can be lifted by a single hook and remain substantially horizontal.

16. In combinationn:

a ladle for molten metal, the ladle being a container with an upper rim, a lid adapted to close the top of the container by sitting on said rim, a lifting assembly located such that the ladle can be moved along a path passing adjacent the lifting assembly, the lid being free of direct attachment to the lifting assembly, means on the lifting assembly and on the lid adapted to cooperate to lift the lid off the ladle as the ladle passes adjacent the lifting assembly, coaxial hinge pins supported by bracket means from the ladle and fixed with respect thereto, and two hinge brackets on the lid, each hinge bracket defining a downwardly opening slot adapted to receive one of said hinge pins, the hinge pin axis being located above the plane of the upper rim of the container and rearwardly thereof when seen in plan view, each hinge bracket extending rearwardly from the lid and having a first part forwardly of its slot and a second part rearwardly of its slot, the two parts being integral above the slot, the second part extending downwardly further than the first part so that its protruding end can be struck by the respective hinge pin when the ladle is retracing the said path, thus drawing the lid back down onto the ladle.

* * * * *